US009334555B2

(12) United States Patent
Ishizuka et al.

(10) Patent No.: US 9,334,555 B2
(45) Date of Patent: May 10, 2016

(54) HOT DIP GALVANNEALED STEEL SHEET AND METHOD FOR PRODUCING THE SAME

(71) Applicant: NIPPON STEEL & SUMITOMO METAL CORPORATION, Tokyo (JP)

(72) Inventors: Kiyokazu Ishizuka, Hyogo (JP); Kazumi Nishimura, Hyogo (JP); Ikuo Kikuchi, Hyogo (JP); Akihiro Miyasaka, Hyogo (JP)

(73) Assignee: NIPON STEEL & SUMITOMO METAL CORPORATION, Tokyo (JP)

( * ) Notice: Subject to any disclaimer, the term of this patent is extended or adjusted under 35 U.S.C. 154(b) by 469 days.

(21) Appl. No.: 13/743,790

(22) Filed: Jan. 17, 2013

(65) Prior Publication Data

US 2013/0129924 A1 May 23, 2013

Related U.S. Application Data

(62) Division of application No. 11/911,916, filed as application No. PCT/JP2006/308369 on Apr. 14, 2006, now abandoned.

(30) Foreign Application Priority Data

Apr. 20, 2005 (JP) ..... 2005-121831
Aug. 22, 2005 (JP) ..... 2005-239384

(51) Int. Cl.
*C23C 2/02* (2006.01)
*C23C 2/06* (2006.01)
*C23C 2/28* (2006.01)

(52) U.S. Cl.
CPC ... *C23C 2/02* (2013.01); *C23C 2/06* (2013.01); *C23C 2/28* (2013.01); *Y10T 428/12799* (2015.01)

(58) Field of Classification Search
CPC ..... C23C 2/02; C23C 2/06
USPC ..... 148/533
See application file for complete search history.

(56) References Cited

U.S. PATENT DOCUMENTS 6,368,728 B1 4/2002 Tobiyama et al.
2004/0055667 A1* 3/2004 Takada et al. ..... 148/533

FOREIGN PATENT DOCUMENTS

JP 59067319 4/1984
JP 59074231 4/1984

(Continued)

OTHER PUBLICATIONS

Notice of Allowance Issued by Intellectual Property Office Ministry of Economic Affairs on Nov. 27, 2009 for Taiwanese Patent Application No. 95114198.

(Continued)

*Primary Examiner* — Jie Yang
(74) *Attorney, Agent, or Firm* — Birch, Stewart, Kolasch & Birch, LLP

(57) ABSTRACT

Exemplary embodiments of the present invention can provide a hot dip galvannealed steel sheet which has excellent corrosion resistance, workability, coatability and appearance. The exemplary galvannealed sheet can include an ultra-low carbon steel sheet having a plating layer which includes about 8 to 13% Fe, about 0.05 to 1.0% Ni, about 0.15 to 1.5% Al, and a balance of Zn and unavoidable impurities. An exemplary method for producing a hot dip galvannealed steel sheet is also provided which can include cleaning an annealed ultra-low carbon steel sheet, preplating it with Ni, rapidly heating the sheet in a nonoxidizing or reducing atmosphere, plating the sheet in a galvanization bath containing Al, wiping it, then rapidly reheating it and either cooling the sheet without any soaking time or soaking and holding it for less than 15 seconds and then cooling it.

9 Claims, 5 Drawing Sheets

(56) References Cited

FOREIGN PATENT DOCUMENTS

| | | |
|---|---|---|
| JP | 61032375 | 7/1986 |
| JP | 03-053054 | 3/1991 |
| JP | 04-013855 | 1/1992 |
| JP | 275649 | 9/1992 |
| JP | 04-333552 | 11/1992 |
| JP | 5106003 | 4/1993 |
| JP | 07003417 | 1/1995 |
| JP | 07034213 | 2/1995 |
| JP | 2526320 | 8/1996 |
| JP | 8269665 | 10/1996 |
| JP | 93417 | 1/1997 |
| JP | 2783452 | 8/1998 |
| JP | 2800285 | 9/1998 |
| JP | 2804167 | 9/1998 |
| JP | 10287964 | 10/1998 |
| JP | 11315360 | 11/1999 |
| JP | 3498466 | 2/2004 |
| JP | 3557810 | 8/2004 |
| TW | 275649 | 3/2007 |

OTHER PUBLICATIONS

Office Action of associated Korean Patent Application No. 9-5-2009-008304583.
Machine Translation, Matsumura et al., JP 11-315366, Nov. 1999.
Machine Translation, Nishimura et al., JP 07-003417, Jan. 1995.
Abstract, Kawaguchi et al., JP 04-013855, Jan. 1992.

* cited by examiner

HOT DIP GALVANNEALED STEEL SHEET AND METHOD FOR PRODUCING THE SAME

CROSS-REFERENCE TO RELATED APPLICATIONS

This application is a divisional application of U.S. patent application Ser. No. 11/911,916 which was filed on Dec. 5, 2008, which is a national stage application of PCT Application No. PCT/JP2006/308369 which was filed on Apr. 14, 2006, and published on Oct. 26, 2006 as International Publication No. WO 2006/112515. This application claims priority from the International Application pursuant to 35 U.S.C. §365, and from Japanese Patent Application No. 2005-121831, filed Apr. 20, 2005, and from Japanese Patent Application No. 2005-239384, filed Aug. 22, 2005, under 35 U.S.C. §119. The entire disclosures of the above-referenced applications are incorporated herein by reference in their entireties.

FIELD OF THE INVENTION

The present invention relates to hot dip galvannealed steel sheet made using an ultra-low carbon steel sheet which can exhibit excellent corrosion resistance, workability, and coatability, and a method of producing the same. Further, the present invention relates to a method of producing hot dip galvannealed steel sheet which can exhibit an improved appearance.

BACKGROUND INFORMATION

Conventional hot dip galvannealed steel sheet, which can be used for manufacturing automobiles or buildings, can exhibit excellent coating adhesion and corrosion resistance characteristics after coating. In automobile applications, for example, there may be a demand for such steel sheet having deep drawability. Thus, large amounts of hot dip galvannealed steel sheet formed using ultra-low carbon steel sheet as a sheet material may be used. In such steel sheet formed using ultra-low carbon steel, a corrosion resistance of a bare sheet and of scratched parts of coatings may not be sufficient. Further, it may be difficult to achieve both suppression of powdering and suppression of flaking when working such steel sheet, and flaws in appearance at the time of electrodeposition coating may occur easily.

A hot dip galvannealed steel sheet exhibiting excellent corrosion resistance which includes steel sheet having a first layer made of a Zn—Fe alloy layer and a second layer made of 8 to 15% Fe, 0.1 to 2% Ni, and 1% or less Al is described, e.g., in Japanese Patent Publication (A) No. 9-3417. Further, a method for producing hot dip galvannealed steel sheet exhibiting excellent corrosion resistance, characterized by preplating the surface of a steel sheet with 0.2 to 2 g/m$^2$ of Ni, then rapidly heating the sheet to 430 to 500° C., hot dip coating the sheet in a galvanization bath containing Al in an amount of 0.05 to 0.25%, wiping the sheet, then heat treating the sheet at 470 to 550° C. for 10 to 40 seconds to promote alloying is described, e.g., in Japanese Patent No. 2783452. The above-referenced Japanese Patent Publication (A) No. 9-3417 and Japanese Patent No. 2783452 describe hot rolled low carbon Al killed steel sheet, and do not describe use of ultra-low carbon steel sheet which can exhibit improved deep drawability.

Ultra-low carbon steel sheet can exhibit a higher degree of cleanliness of ferrite grain boundaries, uneven progress of alloying, and easy growth of the Γ layer as compared with low carbon steel sheet. Thus, certain processes applicable to low carbon steel sheet may not be applicable to ultra-low carbon steel sheet. For example, Japanese Patent Publication (A) No. 9-3417 and Japanese Patent No. 2783452 cited herein above do not describe advantages relating to workability and coating behavior.

For example, a hot dip galvannealed steel sheet obtained by hot dip coating and alloying a sheet in a bath containing less than 0.2% of Al and 0.01 to 0.5% of Ni to give a coating containing 8 to 13% Fe, less than 0.5% Al, 0.02 to 1% Ni, and the balance Zn, and having a Γ layer thickness of the base iron boundary of 0.5μ or less, is described, e.g., in Japanese Patent No. 2804167. However, Japanese Patent No. 2804167 describes only a low carbon steel sheet and does not describe any use or advantages of ultra-low carbon steel sheet. Applying certain processes such as those described herein below to such low carbon steel sheet may produce a Γ layer thickness which may not be 0.5μ or less, and the resulting corrosion resistance, workability, and coatability may also be insufficient.

A method for producing hot dip galvannealed steel sheet which includes plating ultra-low carbon steel sheet with 20 to 70 mg/m$^2$ of Ni, then annealing, hot dip galvanizing, and galvannealing it is described, e.g., in Japanese Patent No. 2800285. However, steel sheet produced using this method may not improve corrosion resistance and, further, may not lead to sufficient workability.

A hot dip galvannealed steel sheet exhibiting excellent slidability and coatability, obtained by plating steel sheet in a hot dip galvanization bath containing 0.1 to 0.2% Al and 0.04 to 0.2% Ni, alloying it by heating at a rate of 10 to 20° C./s temperature rise, and covering 1 to 40% of the surface with a 1 to 10 μm ζ layer, is described, e.g., in Japanese Patent No. 3557810. However, steel sheet formed using this procedure may likely not exhibit sufficient workability including, e.g., insufficient anti-powdering properties and corrosion resistance.

Plating of a steel sheet in a hot dip galvanization bath containing Al to which Ni and at least one of Pb, Sb, Bi, and Sn is added, and alloying under predetermined conditions to obtain hot dip galvannealed steel sheet containing 0.1 to 0.25% Al, 6 to 18% Fe, 0.05 to 0.3% Ni, and 0.001 to 0.01% of at least one of Pb, Sb, Bi, and Sn, is described, e.g., in Japanese Patent No. 3498466. However, this process uses a bath containing four elements and control of such bath may be difficult. Further, dross which can include Ni and Al may be easily formed in the bath. When such dross is caught up in the plating layer, it can lead to deterioration of corrosion resistance, and thus may not be desirable.

For example, ultra-low carbon steel sheet containing Ti can exhibit excellent deep drawability and ductility properties over a wide range of compositions. However, when hot dip galvanizing and further alloying such steel sheet, the Ti in the steel can lead to cleaning of crystal grain boundaries, such that an alloying reaction may be promoted at the crystal grain boundaries. As a result, an outburst reaction may occur easily, leading to overalloying deterioration of anti-powdering properties.

To address such problems, a method for producing hot dip galvannealed steel sheet which includes adding Nb together with Ti so as to control the alloying reaction occurring at the crystal grain boundaries, and thereby improving anti-powdering properties, has been described, e.g., in Japanese Patent Publication (B2) No. 61-32375, Japanese Patent Publication (A) No. 59-67319, Japanese Patent Publication (A) No. 59-74231, and Japanese Patent Publication (A) No.

5-106003. Such methods include adding Nb to Ti, but the addition of Nb can be costly, so it may not be economical.

To improve the anti-powdering properties of Ti-containing ultra-low carbon steel sheet without adding Nb, controlling a steam atmosphere during a cooling process after recrystallization annealing, which can cause crystal grain boundaries to oxidize and suppress outburst at the time of the alloying reaction, is described, e.g., in Japanese Patent Publication (A) No. 10-287964. Oxidation may be difficult to control in such a procedure, and the plating appearance may likely be adversely affected.

A method for producing steel sheet which includes raising the concentration of Al in the hot dip plating bath to between 0.12% and 0.2% or higher and creating locally elevated Al concentration phases at the base iron-plating boundary is described, e.g., in Japanese Patent Publication (A) No. 8-269665. However, the plating layer produced by such method may easily become uneven and the appearance may easily deteriorate.

For example, when hot dip galvannealed steel sheet is used for automobile body panel applications, an uneven appearance of galvannealing often remains even after painting the automobile. Thus, an extremely high quality of appearance may be desirable. Most of this unevenness can result from unevenness of an oxide film of the plated sheet material, unevenness of the fine ingredients, and other unevenness arising from previous processes, although the specific causes may generally be difficult to identify. Solutions for preventing such unevenness may therefore be difficult to achieve. For example, the publications described herein above do not provide guidelines for obtaining an excellent appearance of steel sheet which may be suitable for use in automobile body panels.

When producing hot dip galvannealed steel sheet, an Fe—Al—Zn alloy layer (e.g., a barrier layer) may generally be formed in a hot dip galvanization bath at the base iron-plating boundary. Such alloy layer may be removed by later heat treatment, and an Zn—Fe alloy layer in which Al is diffused can be formed. The Fe—Al—Zn alloy layer can play an important role in controlling the subsequent Zn—Fe alloying reaction and securing plating adhesion. However, the speed of formation of the Fe—Al—Zn alloy layer can be affected by surface conditions of the plated sheet material, flow of solution in the plating bath, etc. Fine differences in thickness of the Fe—Al—Zn alloy layer can have a direct effect on the alloying reaction behavior, and fine unevenness in plating appearance may be induced. Thus, it may not be easy to produce hot dip galvannealed steel sheet which exhibits an excellent appearance.

SUMMARY OF EXEMPLARY EMBODIMENTS OF THE INVENTION

Exemplary embodiments of the present invention can provide hot dip galvannealed steel sheet using an ultra-low carbon steel sheet which can exhibit excellent corrosion resistance, workability, and coatability as a sheet material, and a method for producing the same. Further, an exemplary embodiment of a method for producing hot dip galvannealed steel sheet having an excellent appearance according to the present invention may also be provided.

In addition, exemplary embodiments of the present invention can provide a hot dip galvannealed steel sheet which exhibits excellent corrosion resistance, workability, and coatability. Such steel sheet can include an ultra-low carbon steel sheet having on at least one surface a plating layer which includes, by mass %, between 8% and 13% Fe, between 0.05% and 1.0% Ni, between 0.15% and 1.5% Al, and a balance of Zn and unavoidable impurities. The ratio of Al/Ni can be between 0.5 and 5.0, an average thickness of a Γ layer of the base iron boundary can be 1 μm or less, and a variation of the Γ layer can be ±0.3 μm or less.

Further exemplary embodiments of the present invention can provide a method for producing hot dip galvannealed steel sheet which includes cleaning a surface of an annealed ultra-low carbon steel sheet, preplating it using 0.1 to 1.0 $g/m^2$ of Ni, and rapidly heating the sheet in a nonoxidizing or reducing atmosphere to a sheet temperature of 430 to 500° C. with a temperature rise of 30° C./sec or more. The sheet can then be plated in a hot dip galvanization bath containing 0.1 to 0.2 mass % Al, wiped, and then rapidly heated to between 470 and 600° C. using a temperature rise of 30° C./sec or more, cooled without any soaking time or soaked and held for less than 15 seconds, then further cooled.

Yet further exemplary embodiments of the present invention can provide an Fe—Ni—Al—Zn alloy layer formed at the base iron-plating in the hot dip galvanization bath, e.g., instead of a conventional Fe—Al—Zn alloy layer. Such an Fe—Ni—Al—Zn alloy layer can reduce a variation in behavior for formation of the alloy layer due to the surface conditions of the plated sheet material, flow of the solution in the plating bath, etc. Further, variations I thickness of such an alloy layer may not have a significant effect on a subsequent Zn—Fe alloying reaction. Thus, an extremely good appearance can be obtained using exemplary embodiments of the present invention. For example, exemplary embodiments of the present invention can provide a method for producing a hot dip galvannealed steel sheet which includes forming an Fe—Ni—Al—Zn alloy layer on a base iron boundary using a hot dip galvanization bath, and heat treating the resulting sheet to eliminate the Fe—Ni—Al—Zn alloy layer and form a Zn—Fe alloy layer in which Ni and Al may be diffused.

Thus, exemplary embodiments of the present invention can provide hot dip galvannealed steel sheet using an ultra-low carbon steel sheet which may exhibit excellent corrosion resistance, workability, and coatability, and a method for producing the same. Further exemplary embodiments of the present invention can provide a method for producing hot dip galvannealed steel sheet exhibiting an excellent appearance which may be suitable for use in automobile body panels.

These and other objects, features and advantages of the present invention will become apparent upon reading the following detailed description of embodiments of the invention, when taken in conjunction with the appended claims.

BRIEF DESCRIPTION OF THE DRAWINGS

Further objects, features and advantages of the invention will become apparent from the following detailed description taken in conjunction with the accompanying figures showing illustrative embodiments, results and/or features of the exemplary embodiments of the present invention, in which.

Figure 1:
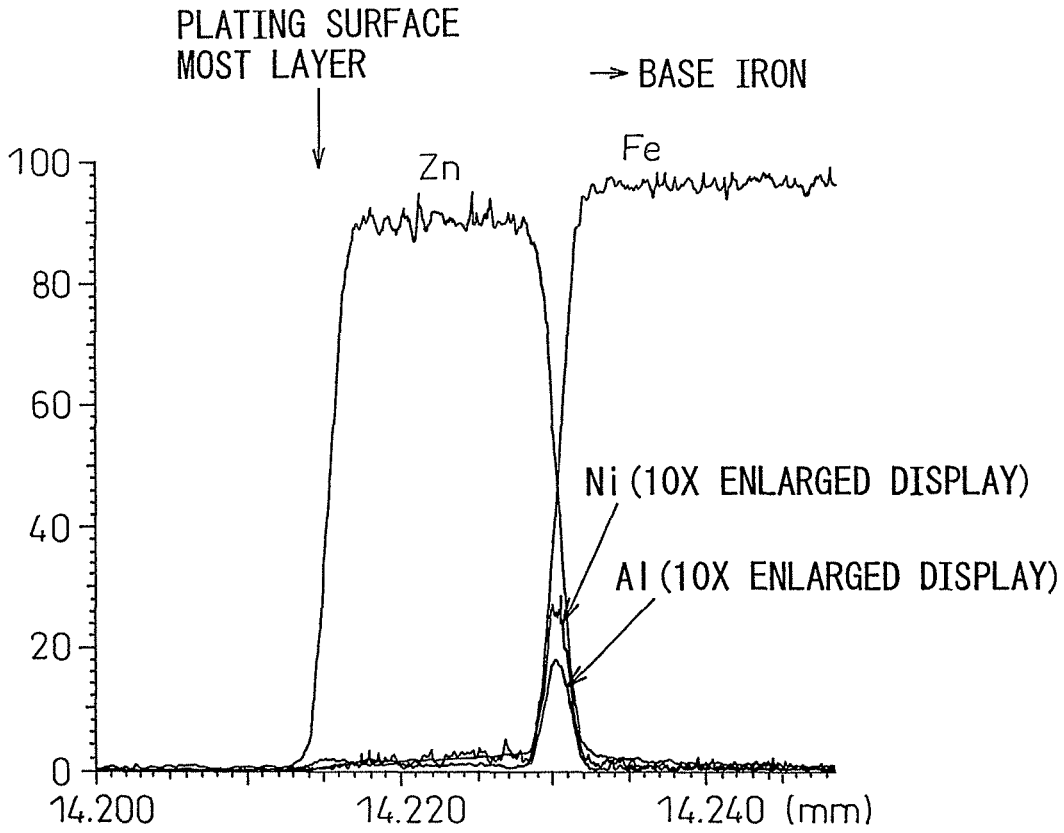
FIG. 1 is a graph of a composition of the plating-base iron boundary alloy layer formed in a hot dip galvanization bath according to exemplary embodiments of the present invention.

Throughout the figures, the same reference numerals and characters, unless otherwise stated, are used to denote like features, elements, components or portions of the illustrated embodiments. Moreover, while the present invention will now be described in detail with reference to the figures, it is done so in connection with the illustrative embodiments.

DETAILED DESCRIPTION OF EXEMPLARY EMBODIMENTS OF THE INVENTION

An ultra-low carbon steel sheet according to exemplary embodiments of the present invention may have Ti, Nb, etc. added to it, alone or complexly, which can eliminate solutal carbon. P, Mn and/or Si may also be added to improve the strength, etc. Further, extremely small amounts of Ni, Cu, Sn and/or Cr, or other so-called trump elements, may also be used.

An ultra-low carbon steel sheet containing by mass %, e.g., 0.005% or less C, 0.03% or less Si, between 0.05% and 0.5% Mn, 0.02% or less P, 0.02% or less S, and between 0.001% and 0.2% Ti (and/or Nb) may be used. Ti, Nb, etc. may be added alone or complexly to eliminate the solute carbon. If Ti (or Nb) is added alone, Nb (or Ti) in an amount of 0.001% or less as unavoidable impurities may further be present.

Further, an ultra-low carbon steel sheet containing 0.005% or less C, 0.03% or less Si, between 0.05% and 0.5% Mn, between 0.02% and 0.1% P, and 0.02% S may be used, where improved strength can be achieved through the addition of P. Such sheet may be used as a sheet material to produce a high strength hot dip galvannealed steel sheet exhibiting good drawability, and can be used for 340 MPa to 390 MPa class automobile body panel applications. For example, a sheet having the composition described herein above may also contain between 0.5% and 2.5% Mn, and may further contain 0.5% or less Si. Such sheet may be used as a sheet material to produce high strength hot dip galvannealed steel sheet which exhibits good drawability and which can be used for 390 MPa to 440 MPa class automobile body panel applications.

For example, the amount of Fe present can be between 8% and 13%, because if less than 8% Fe is present, the corrosion resistance may deteriorate, while if greater than 13% Fe is present then anti-powdering properties may deteriorate.

Between 0.05% and 1.0% Ni can be present, because if less than 0.05% Ni is present, the corrosion resistance may deteriorate, while if greater than 1.0% Ni is present then anti-powdering properties may deteriorate. Presence of between 0.1% and 0.5% Ni may provide particularly good anti-powdering properties.

The amount of Al present can be between 0.15% and 1.5%, because if less than 0.15% Al is present the anti-powdering properties and corrosion resistance may deteriorate, while if greater than 1.5% Al is present, the coatability and corrosion resistance may deteriorate. Better anti-powdering properties may be achieved if greater than 0.3% Al is present, while better coatability may be achieved if less than 0.8% Al is present.

Further, the Al/Ni ratio can be between 0.5 and 5.0. For example, an Al/Ni ratio lower than 0.5 can lead to less-desirable anti-powdering properties is liable to deteriorate, while an Al/Ni ratio greater than 5.0 can lead to deterioration of coatability and corrosion resistance. Better anti-powdering properties can be achieved, e.g., if the Al/Ni ratio is equal to or greater than 1.0.

Certain exemplary embodiments of the present invention can include a Γ layer of the base iron boundary which can have an average thickness of 1 μm or less, and a variation of the thickness of ±0.3 μm or less. The Γ layer thickness can be measured, for example, using an electrolytic peeling technique in which everything except the Γ layer is dissolved in an ammonium chloride aqueous solution by constant potential electrolysis. The Γ layer can then be characterized by constant current electrolysis, by etching a cross-section of the plating using a Nital (alcohol+nitric acid) solution, or by using another conventional etching solution and directly observing the layer with an optical microscope etc. The Γ layer thickness can also be determined, e.g., based on X-ray diffraction strength, etc.

Further, a variation of the Γ layer which may be less than ±0.3 μm can refer to a maximum value and/or a minimum value of the thickness of the Γ layer which may be within 0.3 μm of an average thickness of the Γ layer when measuring several points of the steel sheet along the width of the sheet. The upper limit of the average thickness of the Γ layer of 1 μm in accordance with exemplary embodiments of the present invention may be relatively large. However, a control of this thickness variation can be important for achieving desirable anti-powdering properties and workability. Thus, a control of the Γ layer thickness together with the plating compositions described herein above can result in a steel sheet exhibiting good performance characteristics.

In accordance with certain exemplary embodiments of the present invention, an annealed ultra-low carbon steel sheet can be used as the sheet material. The surface of the sheet can first be cleaned using various techniques such as, e.g., alkali degreasing, brushing, acid treatment, or other conventional techniques, which may be performed alone or in combination based on the amount of dirt or oxide film on the sheet material. To achieve improved uniformity of the Ni plating described herein below, alkali degreasing (for example, NaOH aqueous solution treatment) and acid treatment (for example, sulfuric acid aqueous solution treatment) may preferably be used in combination, and in that order.

In certain exemplary embodiments of the present invention, the sheet can be preplated using 0.1 to 1.0 $g/m^2$ of Ni. Wettability of a further hot dip coating may be insufficient if less than 0.1 $g/m^2$ of Ni is used, and the corrosion resistance may also be insufficient, while anti-powdering properties may deteriorate if greater than 1.0 $g/m^2$ of Ni is used. These factors may also depend on the previously-described cleaning pretreatment. The upper limit for the Ni preplating can preferably be 0.8 $g/m^2$ to obtain better anti-powdering properties.

After the Ni preplating procedure, the sheet can be rapidly heated in a nonoxidizing or reducing atmosphere to a sheet temperature of between 430° C. and 500° C. using a temperature rise of 30° C./sec or higher. This treatment can secure the wettability of the hot dip coating and can further the plating adhesion. For example, the upper limit of the sheet temperature during heating can preferably be 480° C. to provide better anti-powdering properties.

The hot dip galvanization bath which may be used can include between 0.1% and 0.2% of Al, unavoidable impurities, and the balance of Zn. For example, if less than 0.1% of Al is present the anti-powdering properties and corrosion resistance may deteriorate, while if greater than 0.2% of Al is present, the coatability and corrosion resistance may also deteriorate. In exemplary embodiments of the present invention, Ni may not be deliberately added to the plating bath. For example, Ni preplating can be used as a source of Ni for the plating layer, which can avoid the problem of Ni—Al dross forming in the plating bath and being carried to the plating layer, which can then cause the plating layer to become uneven and result in deterioration of performance and other problems. The lower limit of the bath Al concentration can preferably be 0.12% to produce better anti-powdering properties.

After plating, the sheet can be wiped, and then rapidly heated to between 470° C. and 600° C. using a temperature rise of 30° C./sec or more. The plate can then be cooled without any soaking time, or soaked and held for less than 15 seconds, and then cooled for alloying. This exemplary procedure can be important for suppressing the Γ layer, and particularly for suppressing variations in the layer thickness. In particular, if the rate of temperature rise is less than 30° C./second, both the thickness of the Γ layer and the thickness variation may increase.

After the rapid heating, cooling without any soaking time or soaking and holding for a short time (less than 15 seconds), and then cooling further can be important. For example, if such cooling is not performed, both the Γ layer thickness and its variation may increase. An ordinary ultra-low carbon steel sheet may preferably be cooled without any soaking time. If no soaking time is used, the furnace facility can be shortened and the speed does not have to be reduced to allow for soaking. These features may be advantageous for increased productivity. Further, an ultra-low carbon steel sheet which is improved in strength by the addition of P, etc., can be slower to alloy, such that it can be soaked and held for a short time as appropriate. Thus, the sheet can be preferably rapidly heated to between 470 and 550° C. with a temperature rise rate of 30° C./sec or more, cooled without any soaking time, or soaked and held for less than 10 seconds, then further cooled for alloying, which can lead to improved anti-powdering properties.

The plated sheet material used in exemplary embodiments of the present invention can be any appropriate sheet material. However, an extremely good appearance may be desirable, e.g., for automobile body panel applications, so use of an ultra-low carbon steel sheet often used for automobile body panel applications may be particularly effective.

Figure 2:
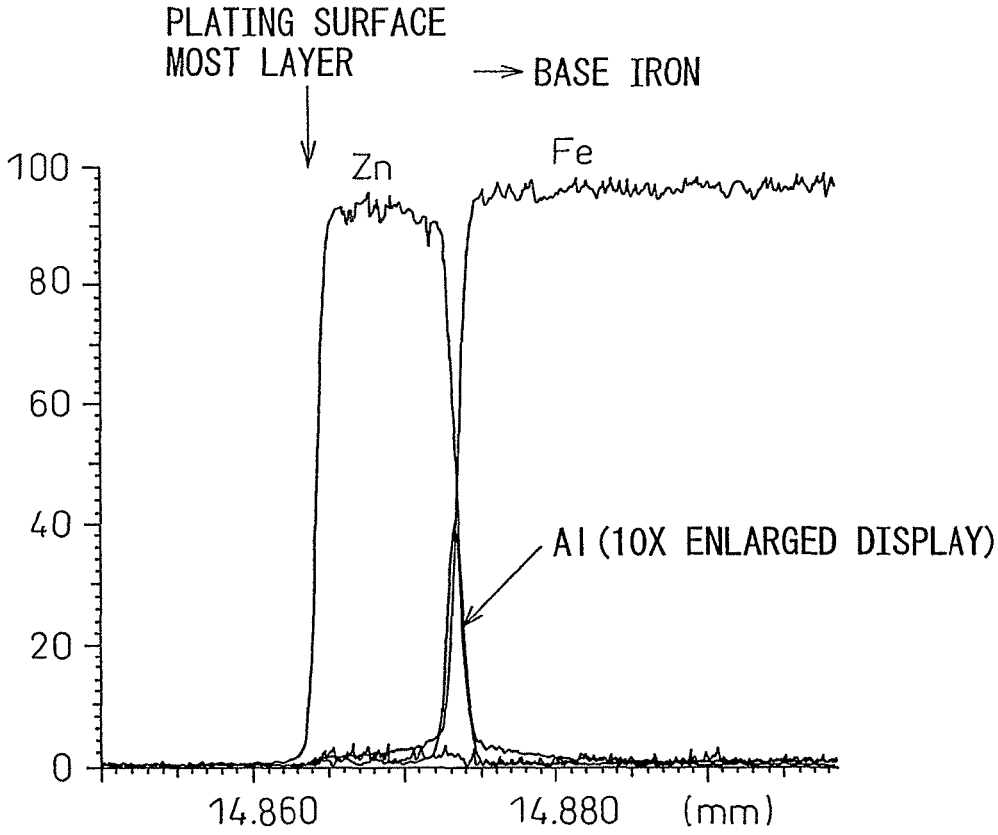
FIG. 2 is a graph of a composition of the plating-base iron boundary alloy layer formed in a conventional hot dip galvanization bath.

FIG. 1 shows a graph of a composition across the alloy layer formed in the hot dip galvanization bath which may be used in accordance with exemplary embodiments of the present invention. For example, an exemplary distribution of elements (Ni, Al, Zn, and Fe) in the plating depth direction is shown in FIG. 1, measured using EPMA analysis of a cross-section of a sample rapidly cooled right after being lifted out from the hot dip galvanization bath and polished embedded. An alloy layer which includes Fe—Ni—Al—Zn can be observed to form at the base iron-plating layer. For comparison purposes, a graph of a composition across a conventional Fe—Al—Zn alloy layer formed at the base iron-plating boundary is shown in FIG. 2. The exemplary compositions shown in FIG. 2 were also determined using EPMA analysis.

Figure 3:
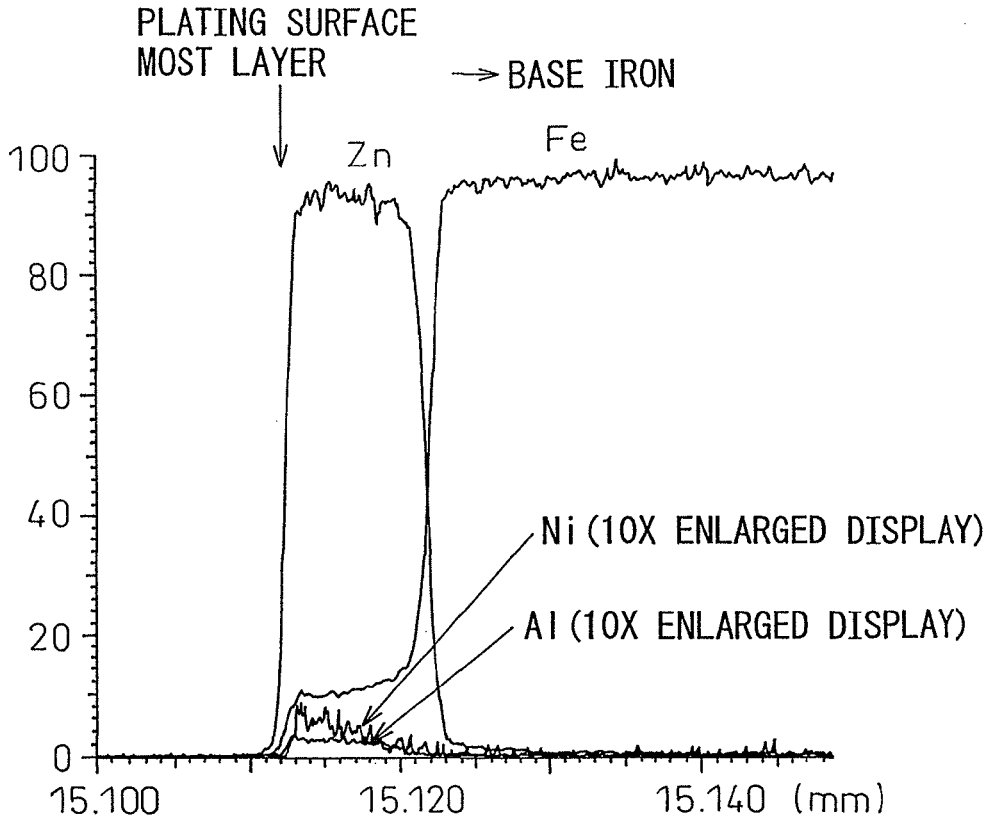
FIG. 3 is a graph of a composition of a hot dip galvannealed layer structure according to exemplary embodiments of the present invention.
Figure 4:
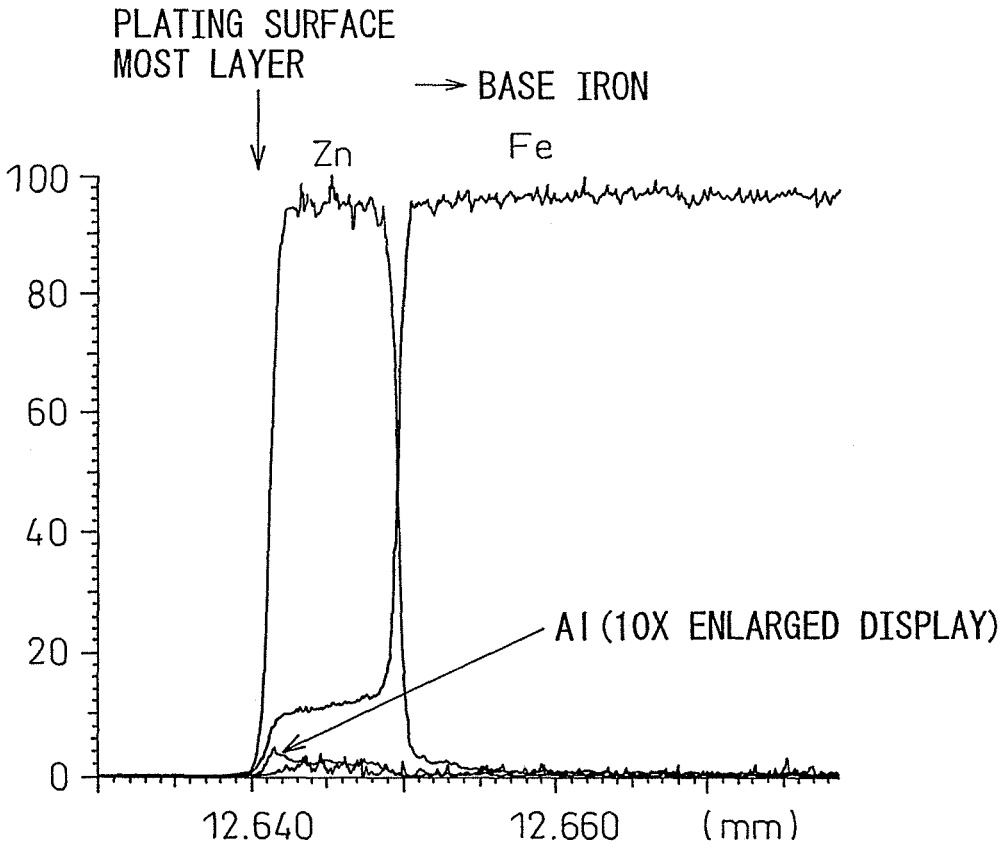
FIG. 4 is a graph of a composition of a conventional hot dip galvannealed layer structure.

FIG. 3 is a graph showing an exemplary distribution of elements (Ni, Al, Zn, and Fe) in the plating depth direction after heating and alloying in accordance with exemplary embodiments of the present invention. The exemplary Fe—Ni—Al—Zn alloy layer of the base iron-plating boundary shown in FIG. 1 disappears, and an exemplary Zn—Fe alloy layer in which Ni and Al are diffused can be observed. For example, FIG. 4 shows, by comparison, an exemplary distribution of elements (Ni, Al, Zn, and Fe) in the plating depth direction after heating and alloying of a sheet having a conventional alloy layer such as that shown in FIG. 2.

In certain exemplary embodiments of the present invention, an exemplary alloy layer and composition profile such as that shown in FIG. 1 can be formed in a hot dip galvanization bath, and the exemplary composition profile shown in FIG. 3 can be achieved by heating and alloying. Performing the exemplary processing steps described herein can result in an improved appearance of the sheet as compared with conventional methods for processing such sheet (e.g., converting the profile shown in FIG. 2 to that shown in FIG. 4). The cause of the improved appearance may be related to a precipitation reaction of Ni, Al, Zn, and Fe in the bath when forming the boundary alloy layer shown in FIG. 1. Because Ni is included, such Ni may act as a nucleus for crystallization. Even if there is some unevenness in the base sheet material, this effect may be concealed or suppressed. Further, barrier action on the Zn—Fe alloying reaction in an Fe—Ni—Al—Zn alloy layer may be less dependent on the thickness of the alloy layer as compared with a Fe—Al—Zn alloy layer, and therefore unevenness of the thickness of the alloy layer may not lead to significant unevenness after alloying.

An exemplary method for producing hot dip galvannealed steel sheet from the alloy layer and composition profile shown in FIG. 1 to achieve the profile shown in FIG. 3 in accordance with exemplary embodiments of the present invention explained above can be described in greater detail. For example, Al in the base iron-plating boundary alloy layer can be provided by the hot dip galvanization bath. Further, Ni can also be provided by the hot dip galvanization bath. However, this can lead to a large amount of Ni being included in the bath and a large amount of undesirable Ni—Al dross being formed. To avoid this problem, the Ni may preferably be provided by preplating the steel sheet as described herein above.

In exemplary embodiments of the present invention, the surface of the sheet can first be cleaned. This can be performed using various techniques such as, e.g., alkali degreasing, brushing, acid treatment, or other conventional techniques, which may be performed alone or in combination based on the amount of dirt or oxide film on the sheet material. To achieve an improved uniformity of the Ni plating described herein below, alkali degreasing (for example, NaOH aqueous solution treatment) and acid treatment (for example, a sulfuric acid aqueous solution treatment) may preferably be used in combination, and, e.g., in that order.

In certain exemplary embodiments of the present invention, the sheet can be preplated using 0.1 to 1.0 $g/m^2$ of Ni. Wettability of a further hot dip coating may be insufficient if less than 0.1 $g/m^2$ of Ni is used. If more than 1.0 $g/m^2$ of Ni is used, a boundary alloy layer as shown in FIG. 1 may become difficult to form in the Zn bath and, as a result, a good appearance may be difficult to obtain.

After Ni preplating, the sheet can be rapidly heated in a nonoxidizing or reducing atmosphere to a sheet temperature of between 430 and 500° C. using temperature rise rate of 30° C./sec or higher. Such heat treatment can secure wettability of the hot dip coating and improve adhesion of the plating.

The hot dip galvanization bath can include, e.g., between 0.07% and 0.2% of Al, unavoidable impurities, and the balance Zn. If less than 0.07% of Al is present, a boundary alloy layer such as that shown in FIG. 1 may become difficult to form, and a good appearance can be hard to obtain.

Figure 5:
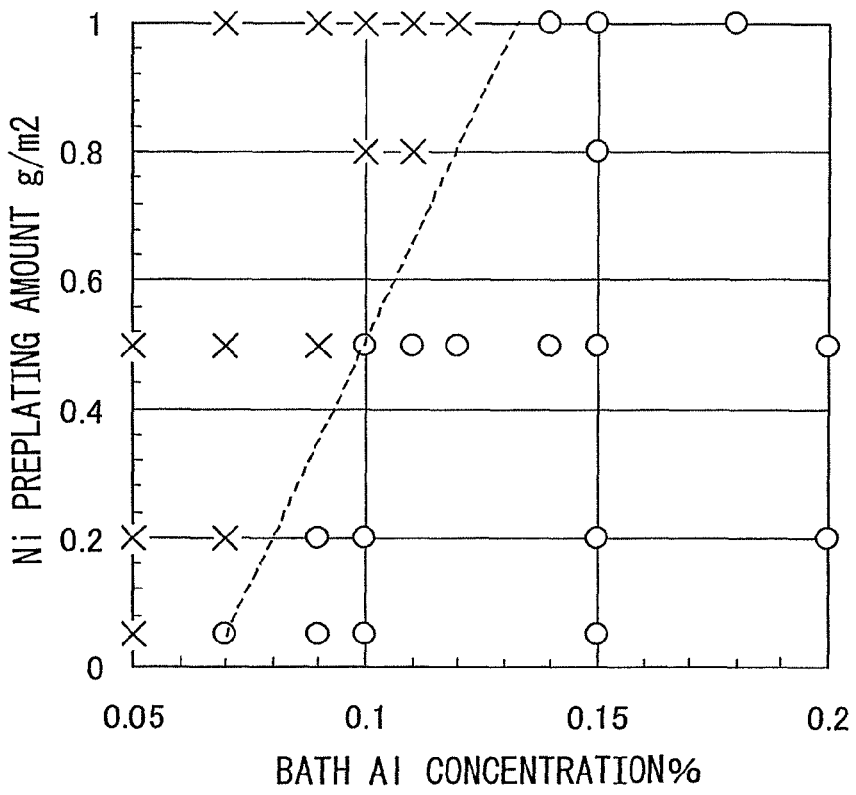
FIG. 5 is a graph showing certain ranges of Al concentration in a bath and an amount of deposition of Ni preplating according to exemplary embodiments of the present invention.

A formation of a boundary alloy layer such as that shown in FIG. 1 can depend on the amount of preplating of Ni and the concentration of Al in the bath. Ultra-low carbon steel sheets with various amounts of Ni preplating applied using various techniques were rapidly heated to 460° C. using a 50° C./sec rate of temperature rise. The sheets were dipped in 455° C. hot dip galvanization baths containing various concentrations of Al, removed from the baths after 3 seconds, and then rapidly cooled to determine a presence of an Fe—Ni—Al—Zn alloy layer at the base iron-plating boundaries. The results of these examples are shown in FIG. 5, where an "O" mark indicates samples where the Fe—Ni—Al—Zn alloy layer was confirmed. The exemplary upper limit of the amount of Ni preplating which formed an alloy layer was observed to decrease with the amount of Al in the bath Al. The region below the dashed line in FIG. 5, where the dashed line can be represented by the relationship [Y]=15 [X]−1 (with [Y] g/m$^2$ of Ni preplating and [X]% of Al concentration in the galvanization bath) can provide suitable process parameters in accordance with exemplary embodiments of the present invention.

After plating and wiping a sheet, the exemplary sheet may preferably be rapidly heated to between 470 and 600° C. using a temperature rise of 30° C./sec or more. The sheet may then be cooled without any soaking time, or it may be soaked and held for less than 15 seconds, then further cooled for alloying. This exemplary cooling procedure can be important for obtaining a good appearance and securing a suitable degree of alloying and plating adhesion.

EXAMPLES (Examples 1-13 and Comparative Examples 1a-11a)

Table 1 shows the exemplary compositions of annealed ultra-low carbon steel sheets used for the examples described herein. These sheets were pretreated using the conditions shown in Table 2, and then preplated with Ni by electroplating in a plating bath having the composition shown in Table 3. The bath temperature used was 60° C., and the current density was 30 A/dm$^2$.

After pretreating and Ni preplating, the sheets were heated in a 3% $H_2$+$N_2$ atmosphere to a temperature of 450° C. at a 50° C./sec rate of temperature rise. The sheets were then immediately dipped in a hot dip galvanization bath warmed to 450° C. and held for 3 seconds, then wiped and adjusted in basis weight. The sheets were then alloyed right above the wiping using a predetermined rate of temperature rise, temperature, and soaking time. The sheets were cooled by gradual cooling at a rate of 2° C./sec for 10 seconds, and then rapidly cooled at a rate of 20° C./sec. After this cooling procedure, the sheets were temper rolled at a reduction rate of 0.5%.

Samples of sheets were produced using various combinations of conditions (amount of preplating of Ni, Al concentration of plating bath, and alloying conditions) as shown in Table 4. The basis weight was 50 g/m$^2$ for each sample.

The compositions and Γ layer thicknesses of the plating layers observed in the samples were measured for each sheet, and the results are shown in Table 5. Each plating layer was dissolved in hydrochloric acid to determine the concentrations of the different components. Further, the Γ layer was measured at 10 points using an electrolytic peeling technique to determine an average layer thickness value, a maximum value, and a minimum value. With respect to variations in thickness of the Γ layer, samples exhibiting a difference greater than 0.3 between either the maximum value and the average value or between the average value and the minimum value were labeled as "Poor."

Table 6 shows a summary of various properties and performance evaluations of the processed steel sheets. The performance was evaluated as follows:

(1) Plating appearance: Visual observation was used, and samples exhibiting no nonplating or other defects were labeled as "Good," samples exhibiting some nonplating or other defects were labeled as "Fair," and samples exhibiting significant amounts of such defects were labeled as "Poor."

(2) Workability (anti-powdering properties): A sample coated with rustproofing oil was pressed (e.g., drawn) using a 40 mm cylinder press using a draw ratio of 2.2, and was evaluated for the degree of blackening by tape peeling at a side surface. Samples exhibiting between 0 to less 20% of blackening were labeled as "Good," samples exhibiting between 20% and 30% of blackening were labeled as "Fair," and those exhibiting 30% or more of blackening were labeled as "Poor."

(3) Workability (slidability): Samples were coated with rustproofing oil and then subjected to a flat plate continuous sliding test. The samples were slid using a compressive load of 500 kgf five consecutive times, and the frictional coefficient at the fifth time was measured. Samples exhibiting a frictional coefficient of less than 0.15 were labeled as "Good," samples exhibiting a frictional coefficient between 0.15 and 0.2 were labeled as "Fair," and those exhibiting a frictional coefficient greater than 0.2 were labeled as "Poor."

(4) Corrosion resistance (rust resistance at scratched parts of coating): Samples of steel sheet was chemically converted by the trication process for automobiles*1, cationically electrodeposition coated*2 (to a thickness of 20 μm), and the coating was then peeled off in a 5 mm×50 mm slit shape to expose the plating surface. A corrosion cycle test*3 was then conducted on the samples. The corrosion resistance was evaluated based on the sample appearance after 10 days. Samples with no rust or only yellow rust were labeled as "Good," samples exhibiting less than 20% of red rust were labeled as "Fair," and those exhibiting more than 20% of red rust were labeled as "Poor."

(5) Corrosion resistance (pitting resistance): Samples were pressed into a U-shape with a bead and flattened. Then, while masking a 40 mm×40 mm area, the samples were chemically converted using a trication process for automobiles*1, and were cationically electrodeposition coated*2 (to a thickness of 20 μm). A bent plate and a flat plate were joined using 0.5 mm spacers so that the uncoated part from which the mask was removed became the inside so as to create a chassis hem model. This sample was then subjected to a corrosion cycle test*3. The corrosion resistance was evaluated by the sample appearance after 30 days. Samples exhibiting less than 20% red rust were labeled as "Good," samples exhibiting between 20% and 50% red rust were labeled as "Fair," and those exhibiting more than 50% of red rust were labeled as "Poor."

(6) Coatability: Steel sheet samples were chemically converted using a trication process for automobiles*1 and were then cationically electrodeposition coated*2. The electrodeposition coating was performed using a voltage of 220V, an upslope of 0.5 minutes, and a total conduction time of 3 minutes. The number of craters and other abnormalities observed in a test piece area of 70×150 mm were counted. Samples exhibiting no abnormalities were labeled as "Good," samples with one or two abnormalities were labeled as "Fair," and those exhibiting three or more abnormalities were labeled as "Poor."

*1: SD5000 made by Nippon Paint,

*2: PN120M made by Nippon Paint,

*3: SST (6 h) => dry 50°C. 45% RH (3 h) => wet 50° C. 95% RH (14 h) => dry 50° C 45% RH (1 h)

TABLE 1

| Types of Test Steel | | | | | | | |
|---|---|---|---|---|---|---|---|
| | Ingredients (mass %) | | | | | | |
| | C | Mn | Si | P | S | Ti | Nb |
| Steel type 1 | 0.0016 | 0.170 | 0.011 | 0.012 | 0.006 | 0.015 | 0.018 |
| Steel type 2 | 0.0020 | 0.381 | 0.003 | 0.059 | 0.006 | — | 0.003 |

TABLE 2

| Pretreatment Conditions | | |
|---|---|---|
| Alkali degreasing | NaOH | 50 g/l |
| | Solution temperature | 65° C. |
| | Dipping 10 sec | |

TABLE 2-continued

| Pretreatment Conditions | | |
|---|---|---|
| Pickling | $H_2SO_4$ | 100 g/l |
| | Solution temperature | 30° C. |
| | Dipping 5 sec | |

TABLE 3

| Pre-Ni Plating Solution | |
|---|---|
| Ingredients | Concentration |
| $NiSO_4 \cdot 6H_2O$ | 300 g/l |
| $H_3BO_3$ | 40 g/l |
| $Na_2SO_4$ | 100 g/l |
| pH | 2.7 |

TABLE 4

| Sample Production Conditions | | | | | | | |
|---|---|---|---|---|---|---|---|
| | | | | Alloying | | | |
| No | Steel type | Ni plating amount ($g/m^2$) | Al % in galvanization bath | Rate of temp. rise (° C./sec) | Temp. (° C.) | Soaking time (sec) | Remarks |
| 1 | 1 | 0.2 | 0.16 | 50 | 500 | 0 | Inv. ex. |
| 2 | 1 | 0.3 | 0.16 | 50 | 500 | 0 | Inv. ex. |
| 3 | 1 | 0.5 | 0.16 | 50 | 500 | 0 | Inv. ex. |
| 4 | 1 | 1.0 | 0.16 | 50 | 500 | 0 | Inv. ex. |
| 5 | 1 | 0.3 | 0.10 | 50 | 500 | 0 | Inv. ex. |
| 6 | 1 | 0.3 | 0.14 | 50 | 500 | 0 | Inv. ex. |
| 7 | 1 | 0.3 | 0.18 | 50 | 500 | 0 | Inv. ex. |
| 8 | 1 | 0.3 | 0.18 | 50 | 550 | 0 | Inv. ex. |
| 9 | 1 | 0.3 | 0.16 | 70 | 500 | 0 | Inv. ex. |
| 10 | 1 | 0.3 | 0.16 | 50 | 500 | 5 | Inv. ex. |
| 11 | 2 | 0.3 | 0.16 | 50 | 580 | 0 | Inv. ex. |
| 12 | 2 | 0.3 | 0.16 | 50 | 550 | 10 | Inv. ex. |
| 13 | 1 | 0.5 | 0.16 | 50 | 470 | 5 | Inv. ex. |
| 1a | 1 | 0 | 0.16 | 50 | 500 | 0 | Comp. Ex. |
| 2a | 1 | 0.05 | 0.16 | 50 | 500 | 0 | Comp. Ex. |
| 3a | 1 | 3 | 0.16 | 50 | 500 | 0 | Comp. Ex. |
| 4a | 1 | 0.3 | 0.08 | 50 | 500 | 0 | Comp. Ex. |
| 5a | 1 | 0.3 | 0.25 | 50 | 500 | 0 | Comp. Ex. |
| 6a | 1 | 0.3 | 0.25 | 50 | 550 | 20 | Comp. Ex. |
| 7a | 1 | 0.3 | 0.16 | 20 | 500 | 0 | Comp. Ex. |
| 8a | 1 | 0.3 | 0.16 | 50 | 500 | 20 | Comp. Ex. |
| 9a | 2 | 0.3 | 0.16 | 50 | 550 | 20 | Comp. Ex. |
| 10a | 1 | 0.5 | 0.16 | 50 | 460 | 20 | Comp. Ex. |
| 11a | 1 | 0.5 | 0.16 | 50 | 610 | 0 | Comp. Ex. |

TABLE 5

| Composition of Plating Layer and Γ Layer Thickness of Test Samples | | | | | | | |
|---|---|---|---|---|---|---|---|
| | Plating layer | | | | | | |
| No. | Fe % | Ni % | Al % | Al/Ni ratio | Γ layer thickness average μm | Variation | Remarks |
| 1 | 10.7 | 0.09 | 0.25 | 2.8 | 0.75 | Good | Inv. ex. |
| 2 | 10.7 | 0.2 | 0.25 | 1.3 | 0.75 | Good | Inv. ex. |
| 3 | 10.7 | 0.4 | 0.51 | 1.3 | 0.75 | Good | Inv. ex. |
| 4 | 10.8 | 0.8 | 0.7 | 0.9 | 0.75 | Good | Inv. ex. |
| 5 | 11.5 | 0.2 | 0.15 | 0.75 | 0.82 | Good | Inv. ex. |
| 6 | 11.1 | 0.2 | 0.19 | 0.95 | 0.78 | Good | Inv. ex. |
| 7 | 9.5 | 0.2 | 0.6 | 3 | 0.45 | Good | Inv. ex. |
| 8 | 11.3 | 0.2 | 0.6 | 3 | 0.78 | Good | Inv. ex. |
| 9 | 10.6 | 0.4 | 0.51 | 1.3 | 0.75 | Good | Inv. ex. |

TABLE 5-continued

Composition of Plating Layer and Γ Layer Thickness of Test Samples

| | Plating layer | | | | | | |
|---|---|---|---|---|---|---|---|
| No. | Fe % | Ni % | Al % | Al/Ni ratio | Γ layer thickness average μm | Variation | Remarks |
| 10 | 11.5 | 0.4 | 0.51 | 1.3 | 0.91 | Good | Inv. ex. |
| 11 | 11 | 0.2 | 0.25 | 1.3 | 0.74 | Good | Inv. ex. |
| 12 | 10.9 | 0.2 | 0.25 | 1.3 | 0.7 | Good | Inv. ex. |
| 13 | 10.7 | 0.4 | 0.51 | 1.3 | 0.76 | Good | Inv. ex. |
| 1a | 10.0 | Less than 0.01% | 0.25 | — | —(not meas.) | —(not meas.) | Comp. Ex. |
| 2a | 10.5 | 0.02 | 0.25 | 12.5 | —(not meas.) | —(not meas.) | Comp. Ex. |
| 3a | 11.5 | 2 | 0.65 | 0.3 | 1.05 | Good | Comp. Ex. |
| 4a | 11.5 | 0.2 | 0.12 | 0.6 | 1.21 | Poor | Comp. Ex. |
| 5a | 7.9 | 0.2 | 1.52 | 7.6 | 0.4 | Poor | Comp. Ex. |
| 6a | 11.5 | 0.2 | 1.52 | 7.6 | 1.29 | Poor | Comp. Ex. |
| 7a | 10.8 | 0.4 | 0.51 | 1.3 | 0.92 | Poor | Comp. Ex. |
| 8a | 12.1 | 0.4 | 0.51 | 1.3 | 1.13 | Good | Comp. Ex. |
| 9a | 11.5 | 0.2 | 0.25 | 1.3 | 0.8 | Poor | Comp. Ex. |
| 10a | 10 | 0.4 | 0.51 | 1.3 | 0.65 | Poor | Comp. Ex. |
| 11a | 13.1 | 0.4 | 0.51 | 1.3 | 1.51 | Good | Comp. Ex. |

TABLE 6

Results of Evaluation of Performance

| | | Workability | | Corrosion resistance | | | |
|---|---|---|---|---|---|---|---|
| No | Plating appearance | Anti-powdering property | Behavior | Rust resistance at scratched parts of coating | Pitting resistance | Coat-ability | Remarks |
| 1 | Good | Good | Good | Good | Good | Good | Inv. ex. |
| 2 | Good | Good | Good | Good | Good | Good | Inv. ex. |
| 3 | Good | Good | Good | Good | Good | Good | Inv. ex. |
| 4 | Good | Good | Good | Good | Good | Good | Inv. ex. |
| 5 | Good | Good | Good | Good | Good | Good | Inv. ex. |
| 6 | Good | Good | Good | Good | Good | Good | Inv. ex. |
| 7 | Good | Good | Good | Good | Good | Good | Inv. ex. |
| 8 | Good | Good | Good | Good | Good | Good | Inv. ex. |
| 9 | Good | Good | Good | Good | Good | Good | Inv. ex. |
| 10 | Good | Good | Good | Good | Good | Good | Inv. ex. |
| 11 | Good | Good | Good | Good | Good | Good | Inv. ex. |
| 12 | Good | Good | Good | Good | Good | Good | Inv. ex. |
| 13 | Good | Good | Good | Good | Good | Good | Inv. ex. |
| 1a | Poor | —(not meas.) | —(not meas.) | —(not meas.) | —(not meas.) | —(not meas.) | Comp. Ex. |
| 2a | Fair | —(not meas.) | —(not meas.) | Poor | —(not meas.) | Poor | Comp. Ex. |
| 3a | Good | Poor | Good | Good | Poor | Fair | Comp. Ex. |
| 4a | Good | Poor | Good | Good | Poor | Good | Comp. Ex. |
| 5a | Good | Good | Poor | Fair | Good | Poor | Comp. Ex. |
| 6a | Good | Poor | Good | Good | Poor | Fair | Comp. Ex. |
| 7a | Good | Poor | Poor | Good | Good | Fair | Comp. Ex. |
| 8a | Good | Poor | Good | Good | Fair | Poor | Comp. Ex. |
| 9a | Good | Fair | Good | Good | Good | Fair | Comp. Ex. |
| 10a | Good | Poor | Poor | Good | Poor | Good | Comp. Ex. |
| 11a | Good | Poor | Good | Good | Poor | Fair | Comp. Ex. |

As shown in Table 6 above, the exemplary steel sheet processed in accordance with exemplary embodiments of the present invention (e.g., samples 1-13) exhibited superior properties to the sheets processed using conventional techniques (e.g., samples 1a-11a).

Examples 14 to 22 and Comparative Examples 12a and 13a

Table 7 shows the compositions of annealed ultra-low carbon steel sheets which were used to perform further tests. These sheets were pretreated using the conditions shown in Table 2, and then preplated with Ni by electroplating in a plating bath having the composition shown in Table 3. The bath temperature used was 60° C., and the current density was 30 A/dm$^2$.

After pretreating and Ni preplating, the sheets were heated in a 4% $H_2$+$N_2$ atmosphere to 455° C. using a 50° C./sec rate of temperature rise. They were then immediately dipped in a hot dip galvanization bath warmed to 450° C., held there for 2.5 seconds. The sheets were then wiped to adjust the basis weight, raised in temperature at a rate of 50° C./sec right above the wiping, held for 4 seconds, and rapidly cooled at a rate of 50° C./sec. The sheets were then temper rolled at a reduction rate of 0.5%.

Comparative Example 14a

The composition of the annealed ultra-low carbon steel sheets used for this test is shown in Table 7. The sheet was pretreated under the conditions shown in Table 2, then heated in a 4% $H_2$+$N_2$ atmosphere to 650° C. at a temperature rise rate of 20° C./sec, held for 60 seconds, and gradually cooled to 455° C. The sheet was then dipped in a galvanization bath warmed to 450° C. and held there for 2.5 seconds. It was then wiped to adjust the basis weight, raised in temperature at a rate of 50° C./sec right above the wiping, held for 4 seconds, and rapidly cooled at a rate of 50° C./sec. After this cooing, the sheet was temper rolled at a reduction rate of 0.5%.

Samples were produced using the various combinations of conditions shown in Table 8 (e.g., amount of preplating of Ni, Al concentration of plating bath, alloying conditions). The basis weight was 50 g/$m^2$ for each sample.

The compositions of the plating layers of the samples listed in Table 8 and the observed Γ layer thicknesses are shown in Table 9. Each sample plating layer was dissolved in hydrochloric acid to determine the concentrations of the different components. The Γ layer was measured at 10 points using an electrolytic peeling technique to determine an average layer thickness value, a maximum value, and a minimum value. With respect to variations in thickness of the Γ layer, samples exhibiting a difference greater than 0.3 μm between either the maximum value and the average value or between the average value and the minimum value were labeled as "Poor".

Table 10 shows a summary of various properties and performance evaluations of the processed steel sheets. The performance was evaluated in the same way as described above for samples 1-13 and 1a-11a. However, the workability (e.g., anti-powdering property) was evaluated under more severe conditions (e.g., a draw ratio of 2.3). The evaluation criteria shown in Table 10 are the same as those described for Table 6.

In addition to the evaluation of the sample properties as shown in Table 6, a low temperature chipping property was added in Table 10. The low temperature chipping property was evaluated as follows. The technique described herein above for evaluating coatability (item (6) above) was followed up to the electrodeposition coating procedure. A polyester-based midcoat was then applied to each sample to a thickness of 30 μm and a topcoat was applied to a thickness of 40 μm. The sample (having a size of 70 mm×150 mm) was then allowed to stand for one day. The coated sample was cooled to −20° C. using dry ice, and 10 pebbles weighing approximately 0.4 g each were dropped on it vertically using an air pressure of 2 kgf/$cm^2$. The coating chipped and raised up by the pebbles was removed, and a maximum value of the peeling diameters was measured. Samples exhibiting a peeling diameter of less than 4 mm were labeled as "Good," samples exhibiting a peeling diameter between 4 mm and 6 mm were labeled as "Fair," and those exhibiting a peeling diameter greater than 6 mm were labeled as "Poor."

TABLE 7

| Types of Test Steel | | | | | | | | | | | |
|---|---|---|---|---|---|---|---|---|---|---|---|
| | Ingredients (mass %) | | | | | | | | | | |
| | C | Mn | Si | P | S | Ti | Nb | Cu | Ni | Cr | Sn |
| Steel type 3 | 0.0011 | 0.12 | 0.009 | 0.010 | 0.005 | 0.017 | 0.02 | 0.075 | 0.03 | 0.04 | 0.01 |
| Steel type 4 | 0.0010 | 0.09 | 0.006 | 0.007 | 0.003 | 0.064 | 0.001 | 0.02 | 0.02 | 0.02 | 0.001 |
| Steel type 5 | 0.0016 | 0.058 | 0.005 | 0.009 | 0.004 | 0.037 | 0.001 | 0.098 | 0.039 | 0.043 | 0.014 |
| Steel type 6 | 0.002 | 0.055 | 0.013 | 0.01 | 0.005 | 0.031 | 0.006 | 0.08 | 0.039 | 0.042 | 0.009 |
| Steel type 7 | 0.003 | 1.652 | 0.323 | 0.081 | 0.006 | 0.009 | 0.024 | 0.124 | 0.039 | 0.059 | 0.013 |

TABLE 8

| Sample Production Conditions | | | | | | | |
|---|---|---|---|---|---|---|---|
| | | | | Alloying | | | |
| No. | Steel type | Amount of Ni plating (g/$m^2$) | Al % in galvan. bath | Rate of temp. rise (° C./sec) | Temp. (° C.) | Soaking time (sec) | Remarks |
| 14 | 3 | 0.3 | 0.16 | 50 | 530 | 4 | Inv. ex. |
| 15 | 4 | 0.3 | 0.16 | 50 | 510 | 4 | Inv. ex. |
| 16 | 4 | 0.6 | 0.18 | 50 | 530 | 4 | Inv. ex. |
| 17 | 5 | 0.3 | 0.16 | 50 | 510 | 4 | Inv. ex. |
| 18 | 5 | 0.6 | 0.18 | 50 | 530 | 4 | Inv. ex. |
| 19 | 6 | 0.3 | 0.16 | 50 | 520 | 4 | Inv. ex. |
| 20 | 6 | 0.6 | 0.18 | 50 | 540 | 4 | Inv. ex. |
| 21 | 7 | 0.3 | 0.16 | 50 | 550 | 4 | Inv. ex. |
| 22 | 7 | 0.6 | 0.18 | 50 | 570 | 4 | Inv. ex. |
| 12a | 3 | 1.1 | 0.1 | 50 | 480 | 4 | Comp. Ex. |
| 13a | 4 | 1.1 | 0.11 | 50 | 470 | 4 | Comp. Ex. |
| 14a | 4 | 0 | 0.18 | 50 | 580 | 4 | Comp. Ex. |

TABLE 9

Composition of Plating Layer and Γ Layer Thickness of Test Samples

| | Plating layer | | | | | | |
|---|---|---|---|---|---|---|---|
| No. | Fe % | Ni % | Al % | Al/Ni ratio | Γ layer thickness average μm | Variation | Remarks |
| 14 | 11.1 | 0.15 | 0.3 | 2 | 0.89 | Good | Inv. ex. |
| 15 | 11 | 0.15 | 0.3 | 2 | 0.91 | Good | Inv. ex. |
| 16 | 10.7 | 0.39 | 0.65 | 1.7 | 0.89 | Good | Inv. ex. |
| 17 | 10.5 | 0.15 | 0.3 | 2 | 0.87 | Good | Inv. ex. |
| 18 | 10.4 | 0.39 | 0.65 | 1.7 | 0.89 | Good | Inv. ex. |
| 19 | 10.5 | 0.15 | 0.3 | 2 | 0.81 | Good | Inv. ex. |
| 20 | 10.5 | 0.39 | 0.65 | 1.7 | 0.8 | Good | Inv. ex. |
| 21 | 10.1 | 0.15 | 0.3 | 2 | 0.7 | Good | Inv. ex. |
| 22 | 10.1 | 0.39 | 0.65 | 1.7 | 0.65 | Good | Inv. ex. |
| 12a | 11.5 | 0.7 | 0.3 | 0.4 | 1.0 | Good | Comp. Ex. |
| 13a | 11.5 | 0.7 | 0.3 | 0.4 | 0.99 | Good | Comp. Ex. |
| 14a | 10.6 | 0 | 0.45 | — | 0.85 | Poor | Comp. Ex. |

TABLE 10

Results of Evaluation of Performance

| | | Workability | | Corrosion resistance | | | | |
|---|---|---|---|---|---|---|---|---|
| No. | Plating appearance | Anti-powdering property | Slid-ability | Rust resistance at scratched parts of coating | Pitting resistance | Coat-ability | Low temp. chipping ability | Remarks |
| 14 | Good | Good | Good | Good | Good | Good | Good | Inv. ex. |
| 15 | Good | Good | Good | Good | Good | Good | Good | Inv. ex. |
| 16 | Good | Good | Good | Good | Good | Good | Good | Inv. ex. |
| 17 | Good | Good | Good | Good | Good | Good | Good | Inv. ex. |
| 18 | Good | Good | Good | Good | Good | Good | Good | Inv. ex. |
| 19 | Good | Good | Good | Good | Good | Good | Good | Inv. ex. |
| 20 | Good | Good | Good | Good | Good | Good | Good | Inv. ex. |
| 21 | Good | Good | Good | Good | Good | Good | Good | Inv. ex. |
| 22 | Good | Good | Good | Good | Good | Good | Good | Inv. ex. |
| 12a | Good | Fair | Good | Good | Good | Good | Fair | Comp. Ex. |
| 13a | Good | Fair | Good | Good | Good | Good | Fair | Comp. Ex. |
| 14a | Good | Poor | Fair | Good | Good | Poor | Fair | Comp. Ex. |

As shown in Table 10 above, the exemplary steel sheet processed in accordance with exemplary embodiments of the present invention (e.g., samples 14-22) exhibited superior properties to the sheets processed using conventional techniques (e.g., samples 12a-14a).

Examples 19 to 25 and Comparative Examples 15a to 17a

The cold rolled annealed sheet materials shown in Table 1 were pretreated as shown in Table 2, then preplated with Ni by electroplating in a plating bath having the composition shown in Table 3. The bath temperature was 60° C., and the current density was 30 A/dm$^2$. After this pretreating and preplating, the sheets were heated in a 3% $H_2$+$N_2$ atmosphere to 460° C. at a temperature rise rate of 50° C./sec, then immediately dipped in a hot dip galvanization bath warmed to 455° C. and held for 3 seconds. The sheets were then wiped and adjusted in basis weight. The basis weight was 60 g/m$^2$. The sheets were then heated and alloyed under predetermined conditions. After heating, the sheets were gradually cooled at a rate of 2° C./sec for 10 seconds, and then rapidly cooled at a rate of 20° C./sec. After this cooling, the sheets were temper rolled using a reduction rate of 0.5%. Samples used for observation of the boundary alloy layer were those dipped in the hot dip galvanization bath, held there for 3 seconds, then rapidly cooled.

Comparative Example 18a

A cold rolled unannealed sheet material having the same composition and same sheet thickness as sheet material 1 of Table 1 was used as the sheet material. The only pretreatment of this sheet was alkali degreasing as shown in Table 2. The sheet was then annealed and reduced in a 10% hydrogen atmosphere at 800° C. for 30 seconds, then cooled to 460° C., dipped in a hot dip galvanization bath warmed to 455° C. and held for 3 seconds. The sheet was then wiped and adjusted in basis weight. The basis weight was 60 g/m$^2$. After this procedure, the sheet was heated and alloyed under predetermined conditions. After heating, the sheet was gradually cooled at a rate of 2° C./sec for 10 seconds, and then rapidly cooled at a rate of 20° C./sec. It was then temper rolled using a reduction rate of 0.5%. Samples used for observation of the boundary alloy layer were those dipped in the hot dip galvanization bath, held there for 3 seconds, then rapidly cooled.

In each of Examples 19 to 25 and Comparative Examples 15a to 18a, as shown in Table 11, the hot dip galvanization bath concentration and Ni preplating amount were adjusted.

The performance of these samples was evaluated as follows:

(1) Hot dip galvanized base iron-plating boundary alloy layer: A cross-section of the sample was polished, embedded, and analyzed using EPMA to assess the condition of the alloy layer. Samples exhibiting an Fe—Ni—Al—Zn alloy layer were labeled as "Good" and others were labeled as "Poor."

(2) Plating appearance (visual): Each sample was irradiated at an acute angle using a fluorescent light, and the presence of any small plating unevenness was detected. Samples exhibiting no such unevenness were evaluated as "Good" and others were labeled as "Poor."

(3) Plating appearance (SEM observation): Samples were observed under 500× power for 20 fields, and the ratio of areas of the surface portions crushed and smoothed by the temper rolling was found. Samples exhibiting a difference between the average value of the area ratios and a maximum or minimum ratio value of less than 10% were labeled as "Good," samples exhibiting such a variation between 10% and 20% were labeled as "Fair", and those exhibiting such a variation greater than 20% were labeled as "Poor."

(4) Alloying degree: Plating layers were dissolved in hydrochloric acid and chemically analyzed to find the concentrations of components and to calculate the percentage of Fe in the plating layer. Samples exhibiting between 9% and 12% Fe were labeled as "Good" and other samples were labeled as "Poor".

(5) Plating adhesion: Samples coated with rustproofing oil were pressed (drawn) by a 40 mm cylinder press under conditions of a draw ratio of 2.2, and a degree of blackening was observed by tape peeling at a side surface. Samples exhibiting a degree of blackening of less than 20% were labeled as "Good," samples exhibiting a degree of blackening between 20% and 30% were labeled as "Fair," and those exhibiting a degree of blackening greater than 30% were labeled as "Poor."

TABLE 11

Sample Production Conditions and Interface Alloy Layer

| | Sheet material | Ni preplating amount ($g/m^2$) | Bath Al % | Fe—Ni—Al—Zn boundary alloy | Alloying conditions Temp. ° C. | Alloying conditions Soaking time sec | Remarks |
|---|---|---|---|---|---|---|---|
| 19 | 1 | 0.05 | 0.15 | Good | 500 | 0 | Inv. ex. |
| 20 | 1 | 0.2 | 0.15 | Good | 500 | 0 | Inv. ex. |
| 21 | 1 | 0.5 | 0.15 | Good | 500 | 0 | Inv. ex. |
| 22 | 1 | 0.5 | 0.1 | Good | 500 | 0 | Inv. ex. |
| 23 | 1 | 1 | 0.18 | Good | 520 | 0 | Inv. ex. |
| 24 | 2 | 0.2 | 0.15 | Good | 550 | 0 | Inv. ex. |
| 25 | 2 | 0.2 | 0.15 | Good | 530 | 5 | Inv. ex. |
| 15a | 1 | 0.01 | 0.15 | * | — | — | Comp. Ex. |
| 16a | 1 | 1.5 | 0.15 | Poor | 500 | 0 | Comp. Ex. |
| 17a | 1 | 0.5 | 0.05 | Poor | 500 | 0 | Comp. Ex. |
| 18a | 1 (not yet annealed) | | 0.11 | Poor | 500 | 0 | Comp. Ex. |

Note:
In Comparative Example 15, a significant amount of nonplating occurred, so the boundary alloy layer was difficult to identify. For this reason, the performance was not evaluated after GA.

TABLE 12

Results of Evaluation of Performance

| | Plating appearance Visual | Plating appearance SEM observation | Alloying degree | Plating adhesion | Remarks |
|---|---|---|---|---|---|
| 19 | Good | Good | Good | Good | Inv. ex. |
| 20 | Good | Good | Good | Good | Inv. ex. |
| 21 | Good | Good | Good | Good | Inv. ex. |
| 22 | Good | Good | Good | Good | Inv. ex. |
| 23 | Good | Good | Good | Good | Inv. ex. |
| 24 | Good | Good | Good | Good | Inv. ex. |
| 25 | Good | Good | Good | Good | Inv. ex. |
| 15a | — | — | — | — | Comp. Ex. |
| 16a | Poor | Poor | Good | Good | Comp. Ex. |
| 17a | Fair | Fair | Good | Fair | Comp. Ex. |
| 18a | Poor | Poor | Good | Good | Comp. Ex. |

As shown in Table 12 above, steel sheet processed in accordance with exemplary embodiments of the present invention (e.g., samples 19-25) exhibited superior properties to the sheets processed using conventional techniques (e.g., samples 15a-18a).

INDUSTRIAL APPLICABILITY

According to exemplary embodiments of the present invention, a hot dip galvannealed steel sheet exhibiting excellent corrosion resistance, workability, and coatability using an ultra-low carbon steel sheet can be provided. Such sheet can be favorably used, e.g., for automobiles as a sheet material. The value of utilizing the methods and products described herein in industry can be significant. For example, a method for producing hot dip galvannealed steel sheet in accordance with exemplary embodiments of the present invention, which exhibits an excellent appearance, can be used for the manufacture of automobile body panels.

The foregoing merely illustrates the principles of the invention. Various modifications and alterations to the described embodiments will be apparent to those skilled in the art in view of the teachings herein. It will thus be appreciated that those skilled in the art will be able to devise numerous systems, arrangements, media and methods which, although not explicitly shown or described herein, embody the principles of the invention and are thus within the spirit and scope of the present invention. In addition, all publications referenced herein above are incorporated herein by reference in their entireties.

The invention claimed is:

1. A method for producing a hot dip galvannealed steel sheet having an average thickness of a Γ layer of a base iron boundary of 1 μm or less, and having a variation of said average thickness of ±0.3 μm or less, comprising:

cleaning a surface of a steel sheet comprising 0.005% C or less, wherein a solutal carbon in the steel sheet is eliminated by adding Ti or Nb, alone or complexly, to the steel sheet;

preplating the annealed steel sheet with between about 0.05 and about 1.0 $g/m^2$ of Ni;

preparing the annealed steel sheet by heating it in at least one of a nonoxidizing atmosphere or a reducing atmosphere to a temperature between about 430° C. and about 500° C. at a rate of at least about 30° C/sec;

plating the carbon steel sheet in a hot dip galvanization bath comprising between about 0.07 and about 0.2 mass % Al;

wiping the carbon steel sheet;

reheating the carbon steel sheet to between about 470° C. and about 600° C. at a rate of at least about 30° C/sec; and cooling the carbon steel sheet without any soaking time, or soaking and holding the carbon steel sheet for 4 seconds or less and then cooling the carbon steel sheet, to form the galvannealed steel sheet.

2. The method of claim 1, wherein the carbon steel sheet is preplated with between about 0.1 and about 1.0 $g/m^2$ of Ni.

3. The method of claim 1, wherein the carbon steel sheet is preplated with between about 0.5 and about 1.0 $g/m^2$ of Ni.

4. The method of claim 1, wherein the carbon steel sheet is preplated with between about 0.1 and about 0.8 $g/m^2$ of Ni.

5. The method of claim 1, wherein the hot dip galvanization bath comprises between about 0.1 and about 0.2 mass % of Al.

6. The method of claim 1, wherein the hot dip galvanization bath comprises between about 0.12 and about 0.2 mass % of Al.

7. The method of claim 1, wherein the heating is performed such that the carbon steel sheet reaches a temperature between about 430° C. and about 480° C.

8. The method of claim 1, wherein the reheating is performed such that the carbon steel sheet reaches a temperature between about 470° C. and about 550° C.

9. The method of claim 1, wherein the concentration of Al in the galvanization bath (expressed as [X] mass %) and the amount of Ni preplating (expressed as [Y] $g/m^2$ of Ni) satisfy the relationship $[Y] \leq 15 \cdot [X] - 1$.

* * * * *